US010862250B2

(12) United States Patent
Yanagisawa

(10) Patent No.: US 10,862,250 B2
(45) Date of Patent: Dec. 8, 2020

(54) POWER SUPPLY CIRCUIT BREAKER DEVICE

(71) Applicant: YAZAKI CORPORATION, Tokyo (JP)

(72) Inventor: Osamu Yanagisawa, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/609,955

(22) PCT Filed: May 31, 2018

(86) PCT No.: PCT/JP2018/021070
§ 371 (c)(1),
(2) Date: Oct. 31, 2019

(87) PCT Pub. No.: WO2018/221686
PCT Pub. Date: Dec. 6, 2018

(65) Prior Publication Data

US 2020/0059046 A1 Feb. 20, 2020

(30) Foreign Application Priority Data

Jun. 2, 2017 (JP) ..... 2017-109989

(51) Int. Cl.
*H01R 13/71* (2006.01)
*H01R 13/631* (2006.01)

(52) U.S. Cl.
CPC ..... *H01R 13/71* (2013.01); *H01R 13/631* (2013.01)

(58) Field of Classification Search
CPC ..... H01R 13/71; H01R 13/631
USPC ..... 200/51.02
See application file for complete search history.

(56) References Cited

U.S. PATENT DOCUMENTS 4,412,116 A * 10/1983 Golub ..... H01H 1/54 200/571
2003/0057958 A1* 3/2003 Fukushima ..... H01H 9/085 324/538
2013/0065412 A1 3/2013 Ikeda et al.

FOREIGN PATENT DOCUMENTS

JP 58-214234 A 12/1983
JP 2001-67994 A 3/2001
JP 2002-133979 A 5/2002
JP 2002133979 * 5/2002 ..... H01H 31/06

(Continued)

*Primary Examiner* — Nguyen Tran
*Assistant Examiner* — Iman Malakooti
(74) *Attorney, Agent, or Firm* — Sughrue Mion, PLLC

(57) ABSTRACT

A power supply circuit breaker device (1) is configured to include: a fixed-side connector device (2) provided partway along a power supply circuit (D); a movable-side connector device (3) which engages/disengages with the fixed-side connector device (2) to turn ON/OFF the power supply circuit (D); and a rotary connection mechanism (4) for engagement/disengagement between the connector devices and turning ON/OFF the power supply circuit. The rotary connection mechanism (4) is configured such that, in the engagement/disengagement between the connector devices and the turning ON/OFF of the power supply circuit, the movable-side connector device (3) is made linearly movable along an engagement direction (P), and the movable-side connector device (3) is made rotatably movable in a direction (Q) around a rotation axis parallel to the engagement direction (P).

3 Claims, 10 Drawing Sheets

(56) References Cited

FOREIGN PATENT DOCUMENTS

| | | | |
|---|---|---|---|
| JP | 2003-100382 | A | 4/2003 |
| JP | 2013-62043 | A | 4/2013 |

* cited by examiner

POWER SUPPLY CIRCUIT BREAKER DEVICE

TECHNICAL FIELD

The present invention relates to a power supply circuit breaker device capable of shutting off a power supply circuit in a connected state.

BACKGROUND ART

A power supply circuit of a hybrid vehicle or an electric vehicle, for example, is a high-voltage circuit. Therefore, in order to ensure working safety by maintenance or the like, it is necessary to shut off power supply of a power supply unit and a load unit. In view of this, it is common to provide a power supply circuit breaker device partway along the power supply circuit, as disclosed in Patent Literature 1.

CITATION LIST

Patent Literature

Patent Literature 1: JP-A-2013-62043

SUMMARY OF INVENTION

Technical Problem

In related art, an electric connection portion in the power supply circuit breaker device is formed by contact between a terminal including a spring and a terminal including a male tab. Since the power supply circuit is the high-voltage circuit, it is necessary to increase a contact load of the spring. For this reason, there is a problem that an operating load of a lever in the power supply breaker device is large, thus operability is deteriorated.

The present invention is made in view of the above circumstances, and an object thereof is to provide a power supply circuit breaker device capable of improving the operability.

Solution to Problem

The above object of the present invention is solved by a power supply circuit breaker device having the following configuration.

(1) A power supply circuit breaker device includes: a fixed-side connector device provided partway along a power supply circuit; a movable-side connector device that engages with or disengages from the fixed-side connector device to turn ON or OFF the power supply circuit; and a rotary connection mechanism, configured such that, in engagement or disengagement between the connector devices and the turning ON/OFF of the power supply circuit, the movable-side connector device is configured to be linearly movable along an engagement direction of the fixed-side connector device and the movable-side connector device, and the movable-side connector device is configured to be rotatably movable in a direction around a rotation axis parallel to the engagement direction.

According to the power supply circuit breaker device having the above configuration (1), the power supply circuit breaker device may have a configuration in which no lever is used. That is, if the configuration in which the movable-side connector device is linearly moved and rotationally moved with respect to the fixed-side connector device to engage with or disengage from the connector devices and turn ON or OFF the power supply circuit is employed, a power supply circuit breaker device having good operability without using levers can be provided.

(2) A power supply circuit breaker device includes: a fixed-side connector device provided partway along a power supply circuit; and a movable-side connector device that engages with or disengages from the fixed-side connector device to turn ON or OFF the power supply circuit. The fixed-side connector device includes: a first terminal having electrical conductivity, which is connected to one side of a divided portion of the power supply circuit; a second terminal having electrical conductivity, which is connected to another side of the divided portion of the power supply circuit; and an electrically insulating fixed-side connector housing, which accommodates the first terminal and the second terminal. The movable-side connector device includes: an electrically insulating movable-side connector housing, which is engaged with the fixed-side connector housing; and a third terminal, which is accommodated in the movable-side connector housing and is configured to contact the first terminal and the second terminal to turn ON the power supply circuit. The first terminal and the second terminal include: a first electric contact portion and a second electric contact portion, each have a tab-shape protruding along an engagement direction of the fixed-side connector device and the movable-side connector device, and are arranged along a direction orthogonal to the engagement direction with a predetermined interval therebetween. The fixed-side connector housing includes: a fixed-side base portion; and a fixed-side cylindrical portion, which is formed in a cylindrical shape so as to surround the first electric contact portion and the second electric contact portion. The movable-side connector housing includes: a movable-side base portion; and a movable-side cylindrical portion, which is formed in a cylindrical shape so as to surround the third terminal and is engaged with the fixed-side connector housing. One of the fixed-side cylindrical portion and the movable-side cylindrical portion includes a boss portion which has a protruding shape, while another one of the fixed-side cylindrical portion and the movable-side cylindrical portion includes a slit-shaped or groove-shaped guide portion which is guided by the boss portion. The guide portion includes: a first guide portion, which is formed along the engagement direction from an opening edge of the other one; a second guide portion, which is continuous with the first guide portion and formed in a direction around a rotation axis parallel to the engagement direction; and a third guide portion, which is continuous with the second guide portion and formed on a side away from the opening edge along the engagement direction.

According to the power supply circuit breaker device having the above configuration (2), the power supply circuit breaker device can have a configuration and a structure in which no lever is used. That is, if the configuration and the structure in which the movable-side connector device is linearly moved and rotationally moved with respect to the fixed-side connector device to engage/disengage the connector devices and turn ON/OFF the power supply circuit are employed, a power supply circuit breaker device having good operability without using levers can be provided. According to this configuration, an operation distance, in a state in which a load due to terminal contact is applied, can be set to be smaller than that in an example in the related art.

(3) The power supply circuit breaker device according to (2), in which the fixed-side base portion includes a support portion configured to support an opposite side of each connection surface of the first electric contact portion and the second electric contact portion.

According to the power supply circuit breaker device having the above configuration (3), a connection state of each connection surface of the first electric contact portion and the second electric contact portion of the first terminal and the second terminal, with respect to the third terminal, can be stabilized.

(4) The power supply circuit breaker device according to (3), in which the power supply circuit breaker device is also provided partway along a signal circuit wired together with the power supply circuit. The fixed-side connector device includes: a fourth terminal having electrical conductivity, which is connected to one side of a divided portion of the signal circuit; a fifth terminal having electrical conductivity, which is connected to another side of the divided portion of the signal circuit; and an electrically insulating fixed-side signal housing, which accommodates the fourth terminal and the fifth terminal. The movable-side connector device includes: an electrically insulating movable-side signal housing, which is engaged with the fixed-side signal housing; and a sixth terminal, which is accommodated in the movable-side signal housing and connected to the fourth terminal and the fifth terminal to perform short-circuiting.

According to the power supply circuit breaker device having the above configuration (4), the signal circuit can also be turned ON/OFF.

Advantageous Effects of Invention

According to the power supply circuit breaker device of the present invention, the operability can be improved when the connector devices are engaged/disengaged and the power supply circuit is turned ON/OFF.

DESCRIPTION OF EMBODIMENTS

A power supply circuit breaker device is configured to include: a fixed-side connector device provided partway along a power supply circuit; a movable-side connector device which engages/disengages with the fixed-side connector device to turn ON/OFF the power supply circuit; and a rotary connection mechanism for engagement/disengagement between the connector devices and turning ON/OFF the power supply circuit. The rotary connection mechanism is configured such that, in the engagement/disengagement between the connector devices and the turning ON/OFF of the power supply circuit, the movable-side connector device is made linearly movable along an engagement direction, and the movable-side connector device is made rotatably movable in a direction around a rotation axis parallel to the engagement direction.

Figure 1:
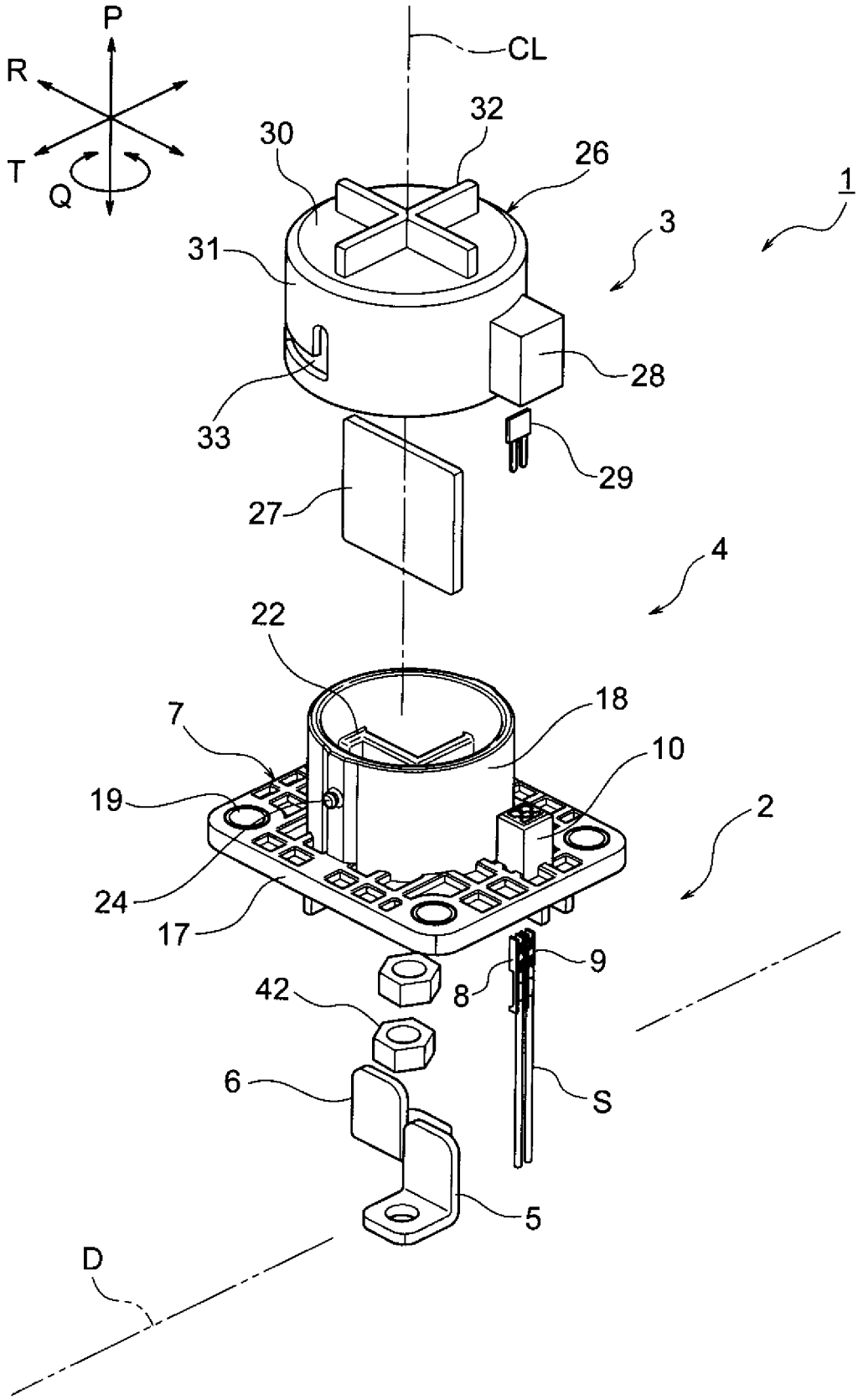
FIG. 1 is an exploded perspective view showing an embodiment of a power supply circuit breaker device of the present invention.
Figure 2:
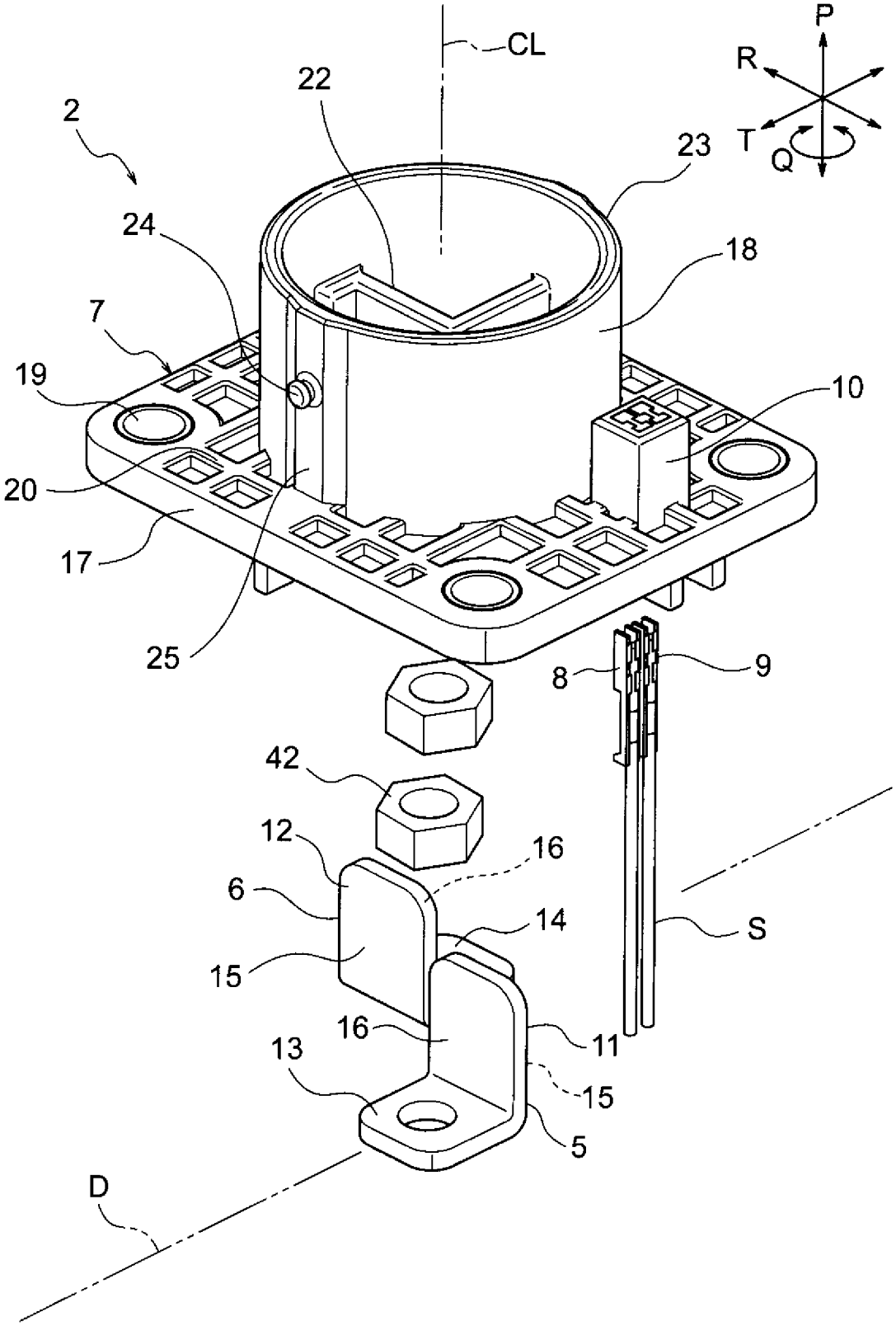
FIG. 2 is an enlarged view of a fixed-side connector device shown in FIG. 1.
Figure 3:
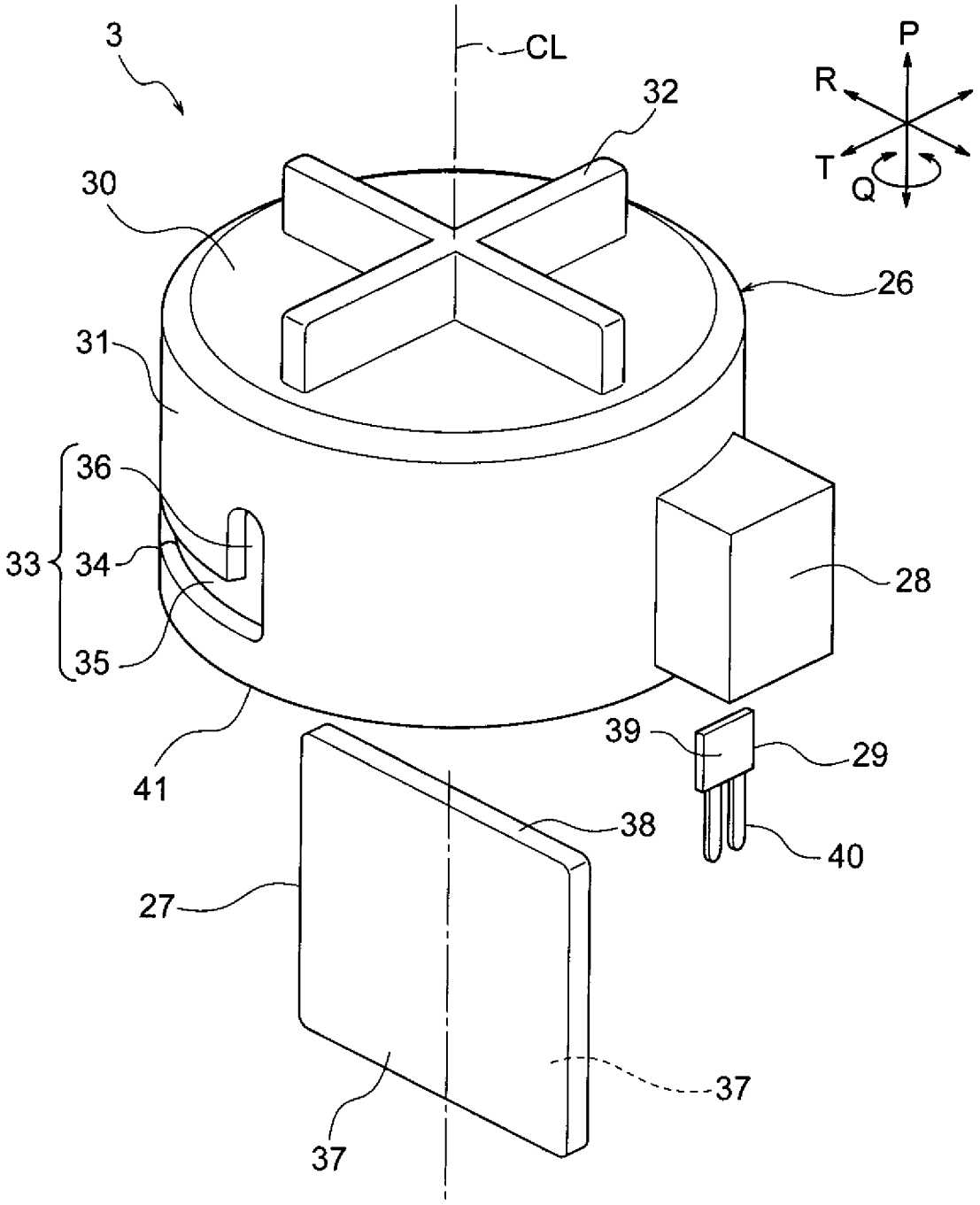
FIG. 3 is an enlarged view of a movable-side connector device shown in FIG. 1.

An embodiment will be described below with reference to the drawings. FIG. 1 is an exploded perspective view showing an embodiment of a power supply circuit breaker device of the present invention. FIG. 2 is an enlarged view of a fixed-side connector device, FIG. 3 is an enlarged view of a movable-side connector device, and FIGS. 4 to 10 show states from a state before engagement of the connector devices to a state where the engagement is completed.

<Power Supply Circuit Breaker Device 1>

In FIG. 1, a power supply circuit breaker device 1 is configured to include: a fixed-side connector device 2 provided partway along a power supply circuit D and a signal circuit S; a movable-side connector device 3 which engages/disengages with the fixed-side connector device 2 to turn ON/OFF the power supply circuit D and the signal circuit S; and a rotary connection mechanism 4 for engagement/disengagement between the connector devices and turning ON/OFF the power supply circuit D and the signal circuit S. The power supply circuit breaker device 1 of the present embodiment corresponds to, for example, a service plug of a hybrid vehicle or an electric vehicle. As will be understood from the following description, the power supply circuit breaker device 1 is a rotary service plug that does not use levers, which is different from examples in the related art.

Reference numeral CL in FIG. 1 denotes a central axis/rotation axis. An arrow P parallel to the central axis/rotation axis CL indicates the engagement direction described in the claims. An arrow Q around the central axis/rotation axis CL indicates the direction around the rotation axis described in the claims. The arrow P indicates an up-down direction in the present embodiment. An arrow R indicates a left-right direction. An arrow T indicates a front-back direction.

<Fixed-Side Connector Device 2>

In FIGS. 1 and 2, the fixed-side connector device 2 includes: a conductive first terminal 5; a conductive second terminal 6; and an electrically insulating fixed-side connector housing 7, which accommodates the first terminal 5 and the second terminal 6. The fixed-side connector device 2 includes: a conductive fourth terminal 8; a conductive fifth terminal 9; and an electrically insulating fixed-side signal housing 10, which accommodates the fourth terminal 8 and the fifth terminal 9. It should be noted that, although "third terminal" and "sixth terminal" are not present in the terminals, these terminals are included in the movable-side connector device 3.

<First Terminal 5 and Second Terminal 6>

In FIGS. 1 and 2, the first terminal 5 and the second terminal 6 have the same shape. The first terminal 5 is connected to one side of a divided portion of the power supply circuit D. The second terminal 6 is connected to the other side of the divided portion of the power supply circuit D. A nut 42 is used in connection between the first terminal 5 and the power supply circuit D, and between the second terminal 6 and the power supply circuit D (it should be noted that the nut 42 is an example of a connection method. The connection method is not particularly limited). Each of the first terminal 5 and the second terminal 6 includes: a first electric contact portion 11 and a second electric contact portion 12 that protrude along the engagement direction P in tab shapes; and a first circuit connection portion 13 and a second circuit connection portion 14 that are continuous with the first electric contact portion 11 and the second electric contact portion 12, and are formed in L shapes as shown in the figure, for example.

The first electric contact portion 11 and the second electric contact portion 12 each include: a connection surface indicated by reference numeral 15; and a support surface indicated by reference numeral 16. The connection surface 15 and the support surface 16 are both formed on a flat surface. The first electric contact portion 11 and the second electric contact portion 12 are arranged along a direction orthogonal to the engagement direction P (see the arrow R) with a predetermined interval therebetween. It should be noted that the predetermined interval is an interval that does not interfere with rotational movement of the third terminal 27, which will be described below. The first electric contact portion 11 and the second electric contact portion 12 are disposed such that the connection surfaces 15 thereof are separated from each other by a thickness of the third terminal 27 (see FIG. 6).

<Fixed-Side Connector Housing 7>

In FIGS. 1 and 2, the fixed-side connector housing 7 is used as a portion for accommodating the first terminal 5 and the second terminal 6. The fixed-side connector housing 7 is also used as an engagement portion, with a movable-side connector housing 26 which will be described below, of the movable-side connector device 3. A fixed-side base portion 17 and a fixed-side cylindrical portion 18 are formed in the fixed-side connector housing 7.

<Fixed-Side Base Portion 17>

Figure 6:
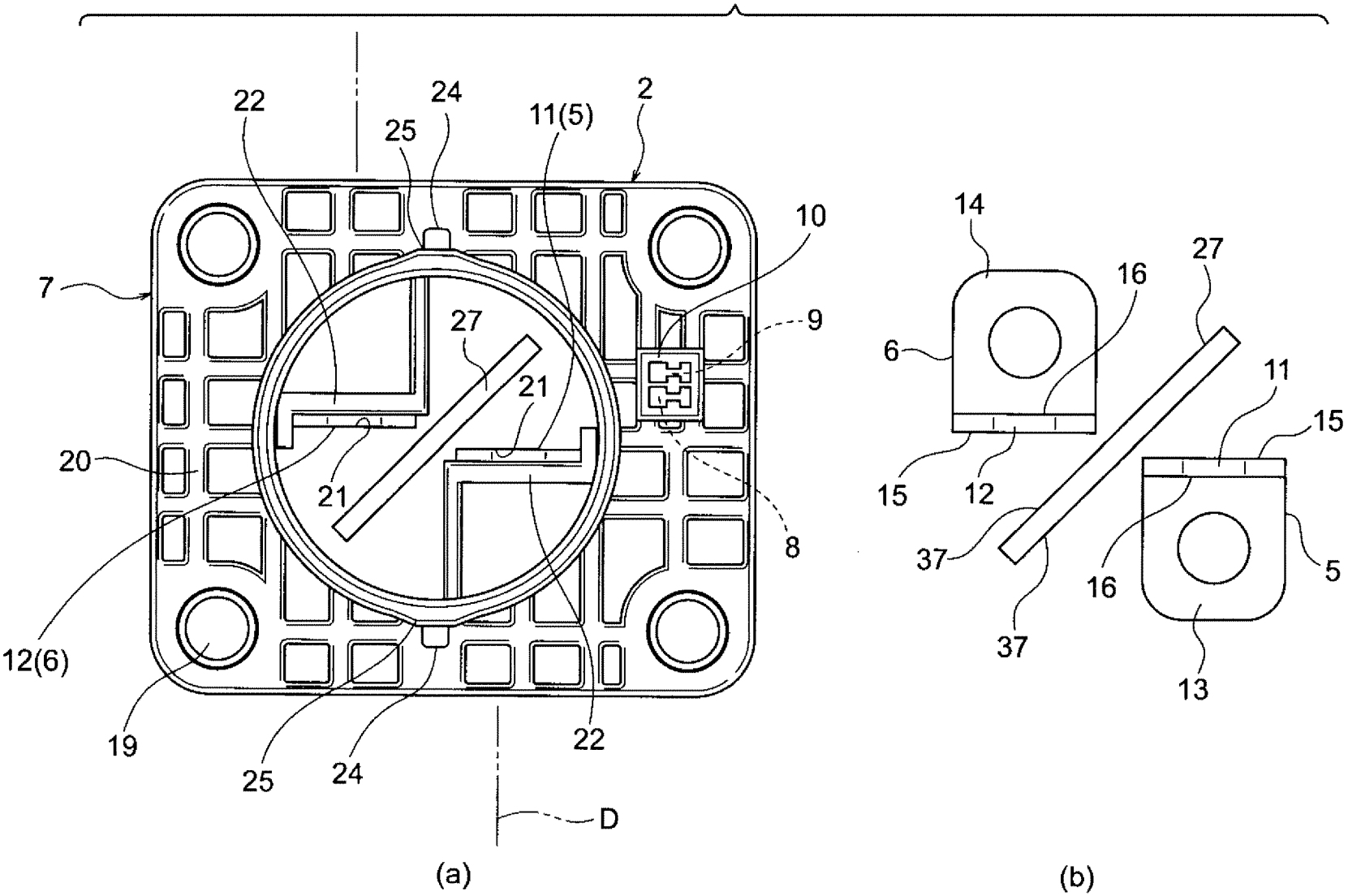
FIG. 6 show the terminal positions at the time of FIG. 5, FIG. 6(*a*) is a plan view of the fixed-side connector device, and FIG. 6(*b*) only shows the terminals of FIG. 6(*a*).

In FIGS. 2 and 6, the fixed-side base portion 17 is formed in a rectangular plate shape in a plan view. Fixing portions 19 are formed at four corners of the fixed-side base portion 17, respectively. A plurality of reinforcing ribs 20 are formed at least on an upper surface of the fixed-side base portion 17. Two terminal insertion holes 21 and two support portions 22 are formed at a center of the fixed-side base portion 17. The two terminal insertion holes 21 are formed as insertion portions of the first electric contact portion 11 and the second electric contact portion 12. The two support portions 22 are formed as portions that support the support surfaces 16, which are opposite to the connection surfaces 15, of the first electric contact portion 11 and the second electric contact portion 12. The two support portions 22 are formed as wall-shaped portions that support the first electric contact portion 11 and the second electric contact portion 12 when pressure from the third terminal 27 described below is received. The two support portions 22 are configured to stabilize an electric contact state.

<Fixed-Side Cylindrical Portion 18>

In FIGS. 1 and 2, the fixed-side cylindrical portion 18 is formed in a cylindrical shape to surround the first electric contact portion 11 and the second electric contact portion 12. The fixed-side cylindrical portion 18 is formed such that an opening edge 23 thereof is positioned above the two support portions 22. A pair of boss portions 24 is formed on an outer peripheral surface of the fixed-side cylindrical portion 18.

<Pair of Boss Portions 24>

In FIGS. 2 and 6, the pair of boss portions 24 is formed as protruding portions protruding in the front-back direction shown by the arrow T. In the present embodiment, the pair of boss portions 24 is formed in a bulging portion 25 which is slightly bulged from the outer peripheral surface of the fixed-side cylindrical portion 18 and extends in the up-down direction shown by the arrow P. The pair of boss portions 24 is formed at a substantially central position of the bulging portion 25. The pair of boss portions 24 is each formed in a shape (reference numeral omitted) having a "constriction", so as to engage with inner and outer edge portions of a guide portion 33 described below.

<Fourth Terminal 8 and Fifth Terminal 9>

In FIGS. 1 and 2, the fourth terminal 8 and the fifth terminal 9 have the same shape. The fourth terminal 8 is connected to one side of a divided portion of the signal circuit S. The fifth terminal 9 is connected to the other side of the divided portion of the signal circuit S. Known low voltage female terminals are employed as the fourth terminal 8 and the fifth terminal 9. Here, a known electric wire is used as the signal circuit S.

<Fixed-Side Signal Housing 10>

In FIGS. 1 and 2, the fixed-side signal housing 10 is formed in a rectangular box-shaped portion protruding upward from the upper surface of the fixed-side base portion 17. A terminal accommodating chamber (not shown) for accommodating the fourth terminal and the fifth terminal, and a locking lance (not shown) are formed inside the fixed-side signal housing 10. A terminal insertion hole (reference numeral omitted), through which a sixth terminal 29 described below is inserted, is formed on an upper surface of the fixed-side signal housing 10. A position of the upper surface of the fixed-side signal housing 10 is set in consideration of positions of the pair of boss portions 24.

<Movable-Side Connector Device 3>

In FIGS. 1 and 3, the movable-side connector device 3 includes: the electrically insulating movable-side connector housing 26 that engages with the fixed-side connector housing 7; a third terminal 27 that is accommodated in the movable-side connector housing 26 and contacts the first terminal 5 and the second terminal 6 to turn ON the power supply circuit D; an electrically insulating movable-side signal housing 28 that engages with the fixed-side signal housing 10; and the sixth terminal 29 which is accommodated in the movable-side signal housing 28 and is connected to the fourth terminal 8 and the fifth terminal 9 to short-circuit the fourth terminal 8 and the fifth terminal 9.

<Movable-Side Connector Housing 26>

In FIGS. 1 and 3, the movable-side connector housing 26 is used as a portion for accommodating the third terminal 27. The movable-side connector housing 26 is also used as an engagement portion with the fixed-side connector housing 7. A movable-side base portion 30 and a movable-side cylindrical portion 31 are formed in the movable-side connector housing 26.

<Movable-Side Base Portion 30>

In FIGS. 1 and 3, the movable-side base portion 30 is formed in a circular portion. A rib 32 extending in the left-right direction shown by the arrow R and in the front-back direction shown by the arrow T is formed on an upper surface of the movable-side base portion 30. The rib 32 is formed in a shape of "+" in a plan view. A terminal fixing portion (not shown) for fixing the third terminal 27 is formed on a lower surface of the movable-side base portion 30.

<Movable-Side Cylindrical Portion 31>

In FIGS. 1 and 3, the movable-side cylindrical portion 31 is formed in a cylindrical shape to surround the third terminal 27. The movable-side cylindrical portion 31 is sized to engage with an outer side of the fixed-side cylindrical portion 18. A pair of guide portions 33 is formed on a wall of the movable-side cylindrical portion 31.

<Pair of Guide Portions 33>

In FIGS. 1 and 3, the pair of guide portions 33 is formed in slit shapes (or groove shapes) that are guided by the pair of boss portions 24. The pair of guide portions 33 is formed in a shape shown in the figure, which includes: a first guide portion 34, which is cutout along the engagement direction P from an opening edge 41 of the movable-side cylindrical portion 31; a second guide portion 35, which is continuous with the first guide portion 34 and cutout in the direction Q around the rotation axis; and a third guide portion 36, which is continuous with the second guide portion 35 and cutout on a side away from the opening edge 41 along the engagement direction P. Slit widths of the pair of guide portions 33 are set to be substantially the same size as diameters of the pair of boss portions 24. Formation positions of each portion of the pair of guide portions 33 are set in consideration of terminal connection positions.

<Third Terminal 27>

In FIGS. 1 and 3, the third terminal 27 is formed in a rectangular plate shape. The third terminal 27 has enough rigidity so as not to be bent. Reference numeral 37 in the third terminal 27 denotes connection surfaces. The connection surfaces 37 are formed on flat surfaces on two surfaces of the third terminal 27. Reference numeral 38 in the third terminal 27 denotes a fixed portion fixed to the terminal fixing portion (not shown) of the movable-side base portion 30. The third terminal 27 has a width dimension, a height dimension, and a thickness dimension which are necessary for contacting the respective connection surfaces 15 of the first electric contact portion 11 and the second electric contact portion 12.

<Movable-Side Signal Housing 28>

In FIGS. 1 and 3, the movable-side signal housing 28 is formed in a rectangular box-shaped portion that is integrated with an outer peripheral surface of the movable-side cylindrical portion 31. A lower surface of the movable-side signal housing 28 is opened. The movable-side signal housing 28 is sized to engage with an outer side of the fixed-side signal housing 10.

<Sixth Terminal 29>

In FIGS. 1 and 3, the sixth terminal 29 is a terminal configured to short-circuit the fourth terminal 8 and the fifth terminal 9 as described above, and includes a fixed portion 39 fixed to the movable-side signal housing 28 and a pair of male tabs 40.

<Rotary Connection Mechanism 4>

In FIGS. 1 to 3, the rotary connection mechanism 4 has a configuration and a structure that enable the movable-side connector device 3 to be made linearly movable along the engagement direction P, and enable the movable-side connector device 3 to be made rotatably movable in the direction Q around the rotation axis during engagement/disengagement between the fixed-side connector device 2 and the movable-side connector device 3 and turning ON/OFF of the power supply circuit D and the signal circuit S. Specifically, the rotary connection mechanism 4 corresponds to a shape and arrangement of the first terminal 5 and the second terminal 6, a shape of the fixed-side cylindrical portion 18, a shape and arrangement of the pair of boss portions 24, and the two support portions 22 in the fixed-side connector device 2. The rotary connection mechanism 4 corresponds to a shape of the movable-side cylindrical portion 31, a shape and arrangement of the pair of guide portions 33, a shape and arrangement of the third terminal 27 in the movable-side connector device 3. Further, the rotary connection mechanism 4 corresponds to the fourth terminal 8 and the fifth terminal 9, the fixed-side signal housing 10, the movable-side signal housing 28, and the sixth terminal 29.

<Engagement Between Fixed-Side Connector Device 2 and Movable-Side Connector Device 3>

The engagement between the fixed-side connector device 2 and the movable-side connector device 3 will be described with reference to FIGS. 4 to 10 based on the above configuration and structure.

Figure 4:
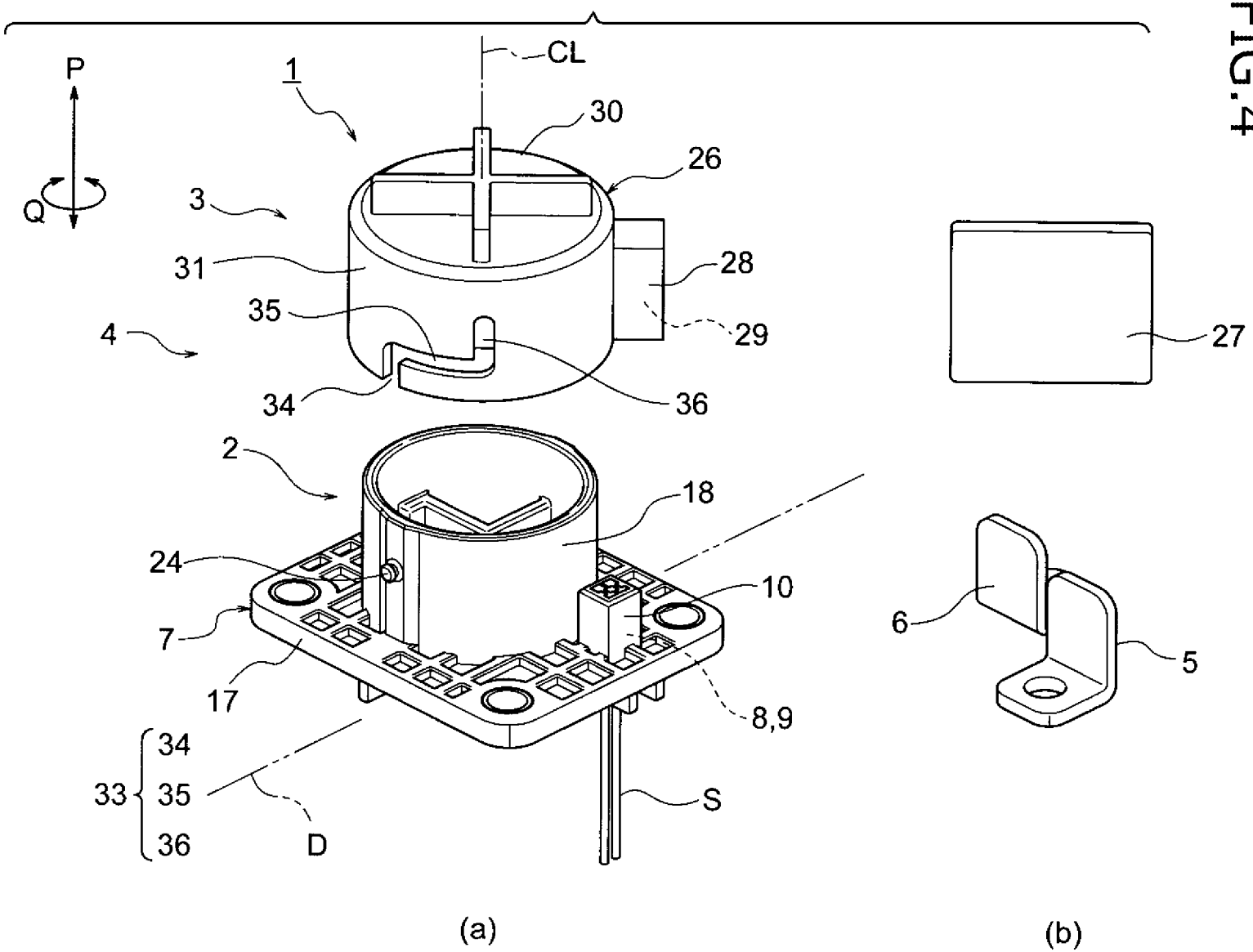
FIG. 4 show a state before engagement between the connector devices, FIG. 4(*a*) is a perspective view showing an appearance of the devices, and FIG. 4(*b*) is a perspective view showing terminal positions.

In FIG. 4, in a state before the engagement between the connector devices, the movable-side connector device 3 is set above the fixed-side connector device 2. At this time, the first guide portion 34 of the pair of guide portions 33 is disposed directly above the pair of boss portions 24. The third terminal 27 is also disposed directly above the first terminal 5 and the second terminal 6 (the third terminal 27 is disposed in a positional relationship such that a width direction of the third terminal 27 intersects an arrangement direction of the first terminal 5 and the second terminal 6).

Figure 5:
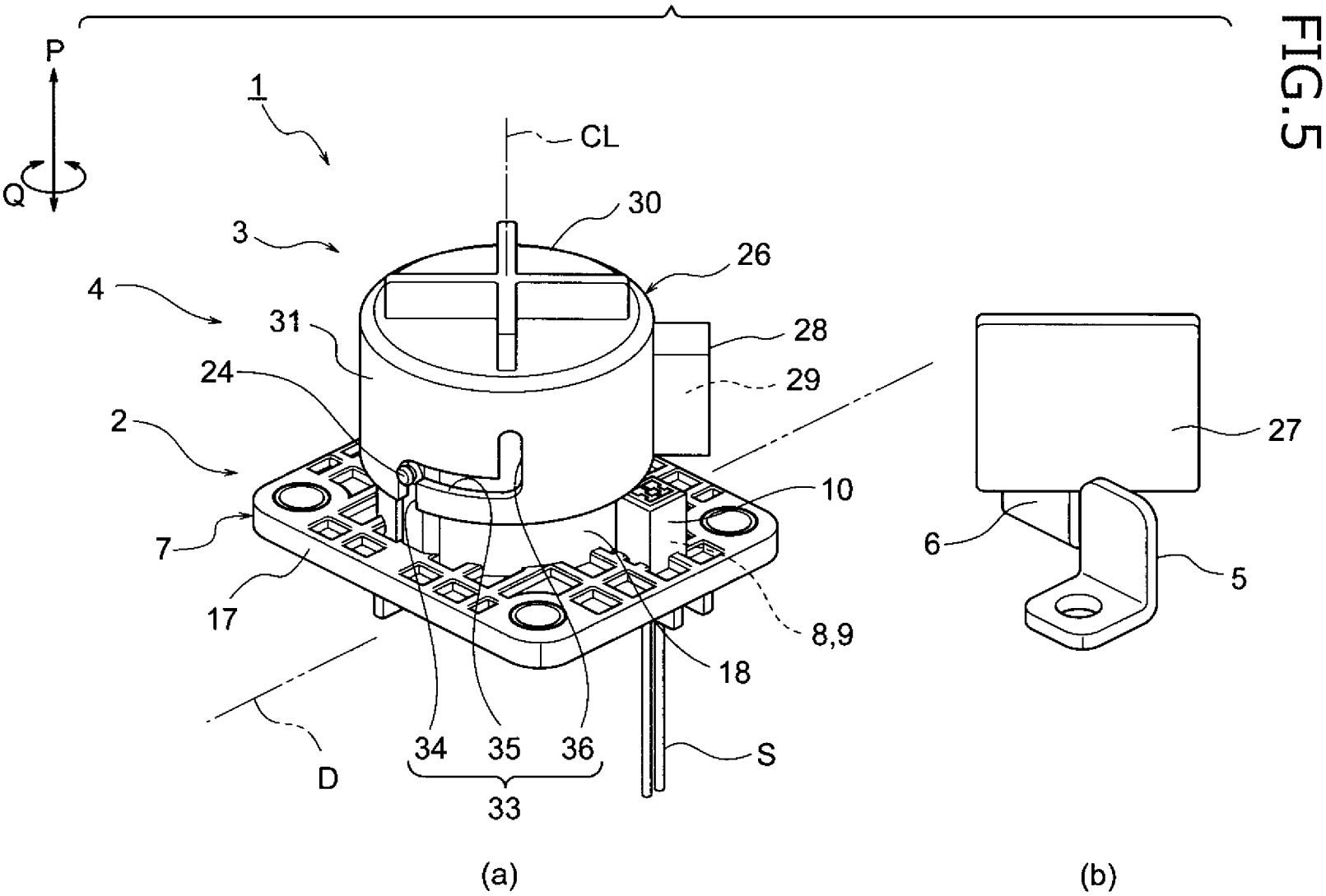
FIG. 5 show a state where the engagement between the connector devices is started, FIG. 5(*a*) is a perspective view showing the appearance of the devices, and FIG. 5(*b*) is a perspective view showing the terminal positions.

In FIGS. 5 and 6, in a state where the engagement between the connector devices is started, the movable-side cylindrical portion 31 starts to engage with the fixed-side cylindrical portion 18. At this time, the first guide portion 34 of the pair of guide portions 33 is guided by the pair of boss portions 24. The third terminal 27 starts to be inserted between the first terminal 5 and the second terminal 6 in a non-contact state. When the first guide portion 34 is guided to a deep position by the pair of boss portions 24, the linear movement of the movable-side connector device 3 in the engagement direction P is temporarily disabled.

Figure 7:
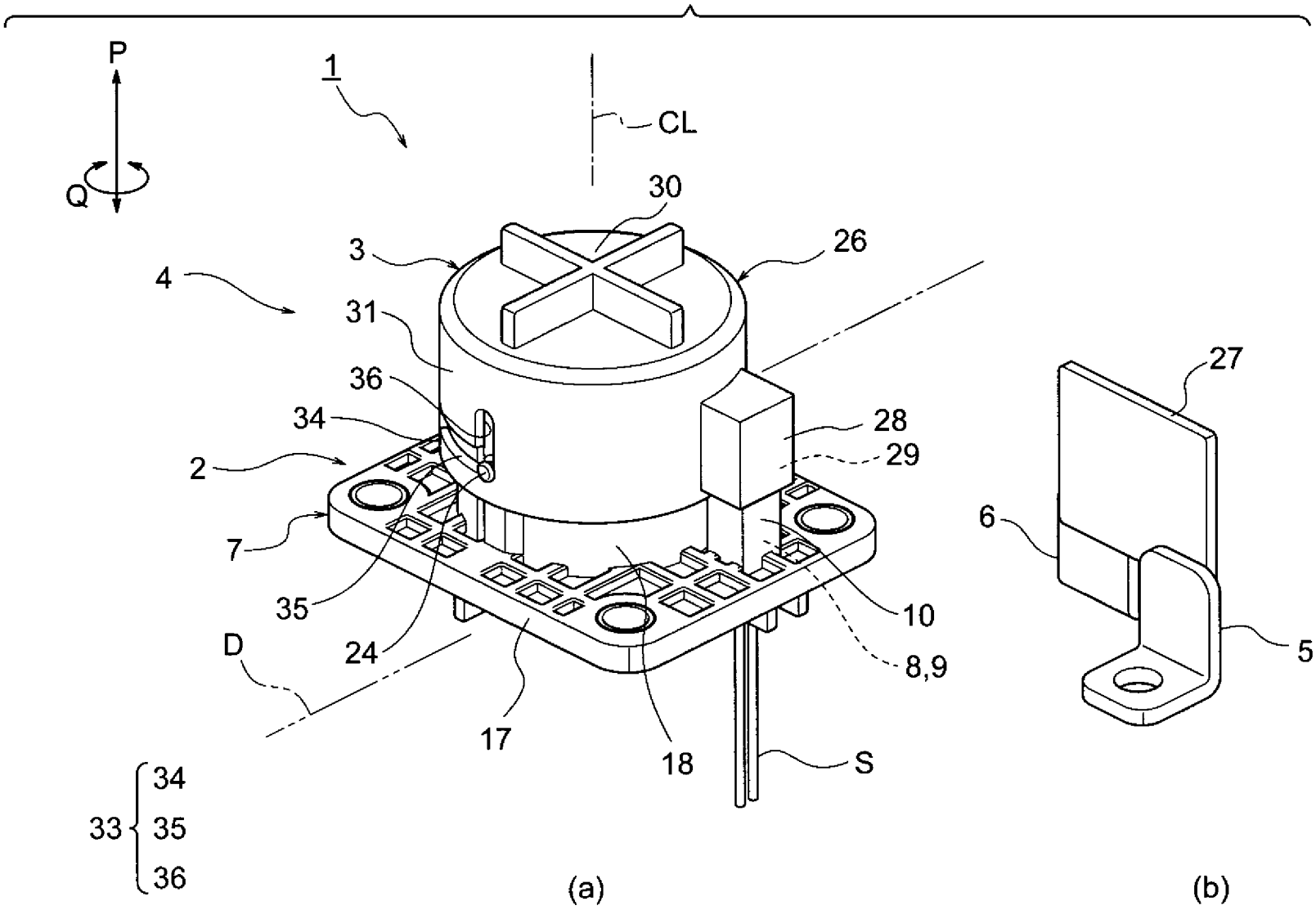
FIG. 7 show a state during the engagement between the connector devices, FIG. 7(*a*) is a perspective view showing the appearance of the devices, and FIG. 7(*b*) is a perspective view showing the terminal positions.
Figure 8:
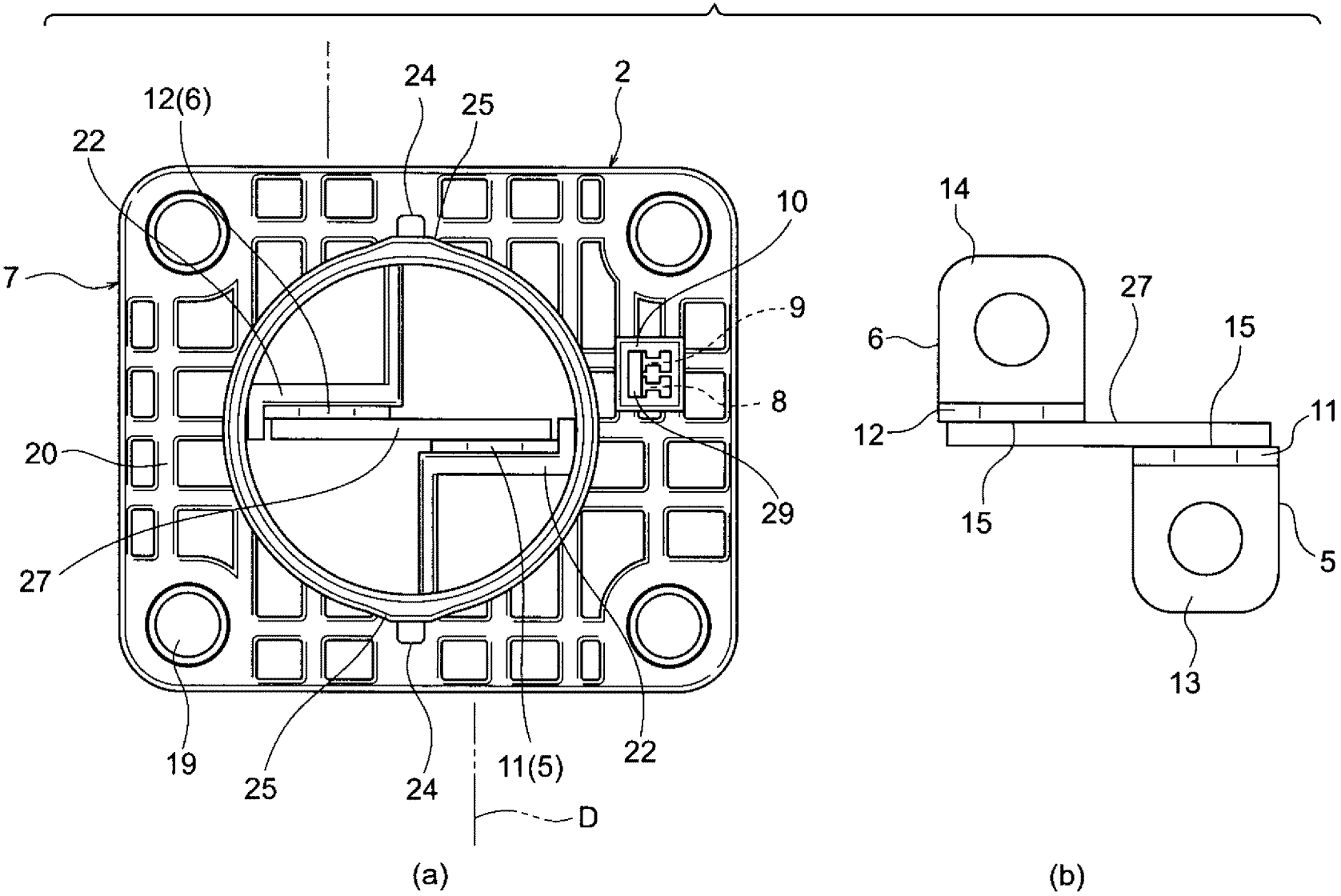
FIG. 8 show the terminal positions at the time of FIG. 7, FIG. 8(*a*) is a plan view of the fixed-side connector device, and FIG. 8(*b*) only shows the terminals of FIG. 8(*a*).

In FIGS. 7 and 8, in a state where the connector devices are being engaged with each other, the movable-side connector device 3 is rotated clockwise so that the third terminal 27 contacts the first terminal 5 and the second terminal 6. At this time, the second guide portion 35 of the pair of guide portions 33 is guided by the pair of boss portions 24. The third terminal 27 also rotates about the central axis/rotation axis CL and contacts the first terminal 5 and the second terminal 6. When the third terminal 27 contacts the first terminal 5 and the second terminal 6, a temporary connection state is formed.

In a state shown in FIG. 7, the movable-side signal housing 28 is disposed directly above the fixed-side signal housing 10. In other words, the short-circuiting sixth terminal 29 is disposed directly above the fourth terminal 8 and the fifth terminal 9.

Figure 9:
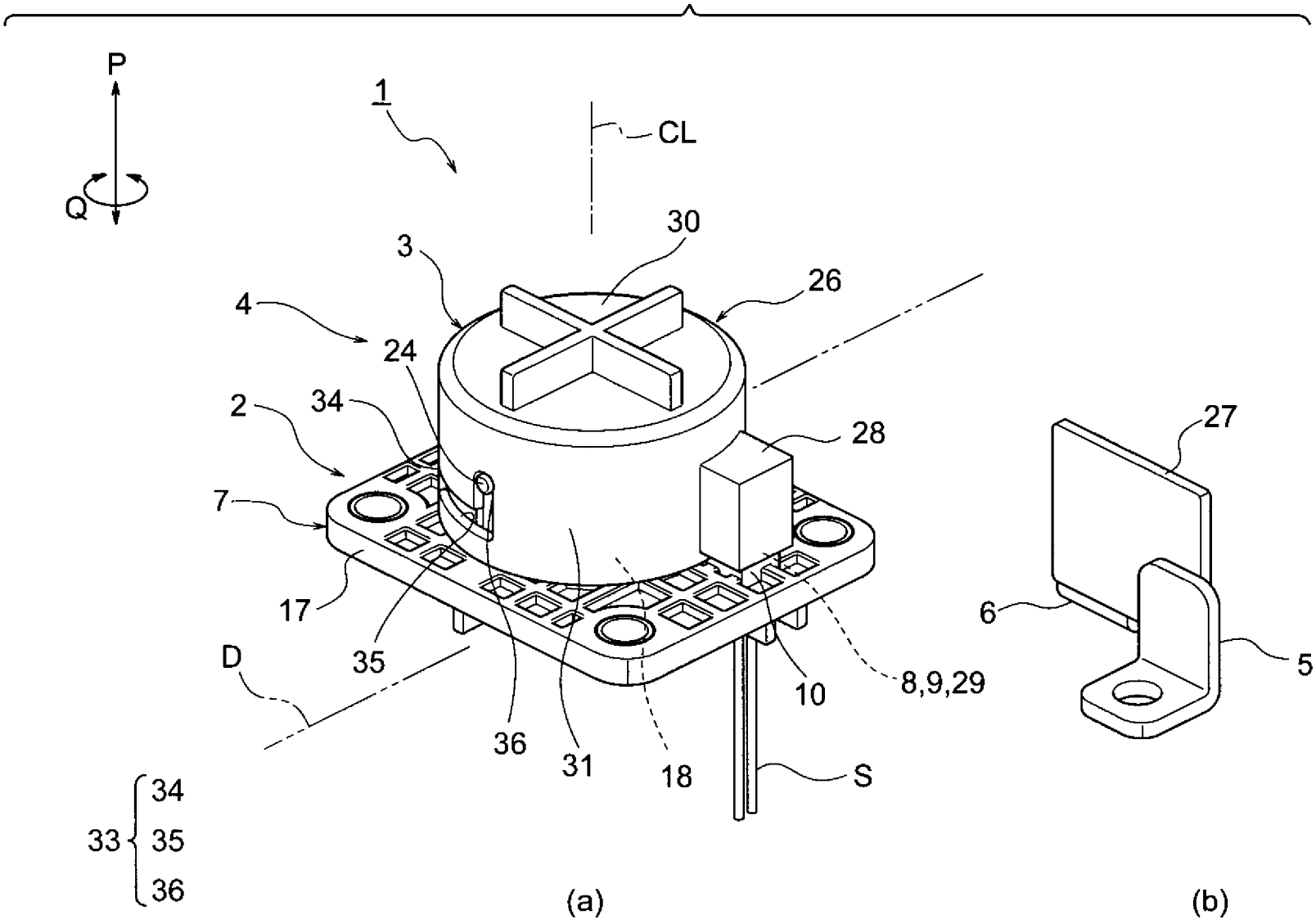
FIG. 9 show a state where the engagement between the connector devices is completed, FIG. 9(*a*) is a perspective view showing the appearance of the devices, and FIG. 9(*b*) is a perspective view showing the terminal positions.
Figure 10:
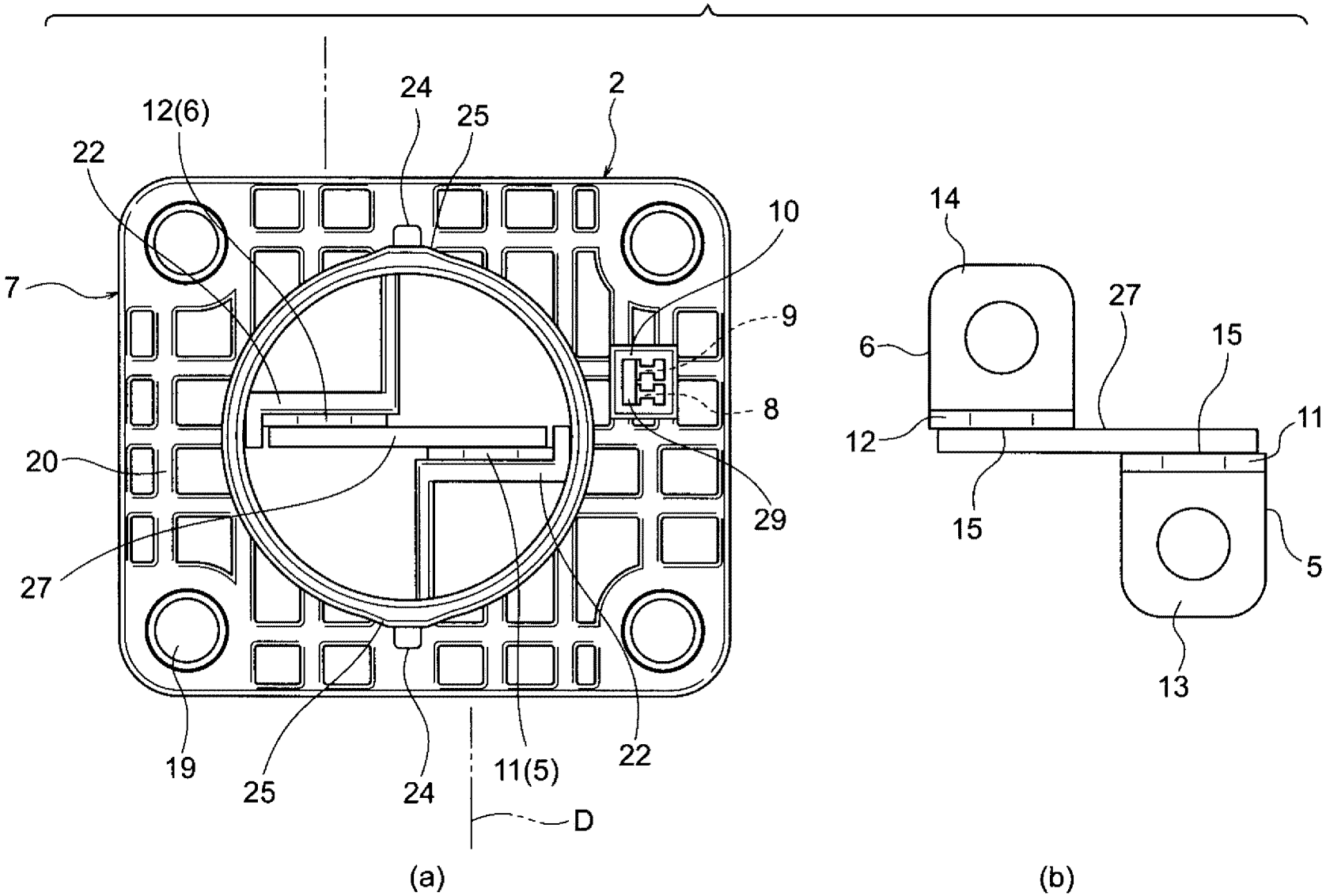
FIG. 10 show the terminal positions at the time of FIG. 9, FIG. 10(*a*) is a plan view of the fixed-side connector device, and FIG. 10(*b*) only shows the terminals of FIG. 10(*a*).

In FIGS. 9 and 10, in a state where the engagement between the connector devices is completed, the movable-side cylindrical portion 31 is linearly moved in the engagement direction P so as to be completely engaged with the fixed-side cylindrical portion 18. At this time, the third guide portion 36 of the pair of guide portions 33 is guided to the deep position by the pair of boss portions 24. The third terminal 27 also linearly moves in the engagement direction P and is pushed while being in contact with the first terminal 5 and the second terminal 6. Accordingly, the present connection state is formed. Further, the movable-side signal housing 28 is engaged with the fixed-side signal housing 10, and the fourth terminal 8 and the fifth terminal 9 are short-circuited by the sixth terminal 29. Accordingly, the power supply circuit D and the signal circuit S are turned ON.

The present connection state is maintained by engagement between the pair of guide portions 33 and the pair of boss portions 24 (no special lock structure is necessary for this maintenance). An operation distance in a state in which a load is applied in this connection is equal to a distance by which the third guide portion 36 is guided to the deep position by the pair of boss portions 24. That is, it is understood that the operation distance is short.

As described above with reference to FIGS. 1 to 10, according to the power supply circuit breaker device 1 according to the embodiment of the present invention, a configuration and a structure, in which no lever as in the example in the related art is used, can be employed. That is, since the power supply circuit breaker device 1 has the configuration and the structure in which the movable-side connector device 3 is linearly moved and rotationally moved with respect to the fixed-side connector device 2 to engage/disengage the connector devices and turn ON/OFF the power supply circuit D and the signal circuit S, the operability can be improved without using levers. As can be seen from the above configuration and structure, the configuration and structure can be simplified as compared with the example in the related art.

Needless to say, various modifications can be made to the present invention without departing from the spirit of the present invention.

This application is based on the Japanese Patent Application filed on Jun. 2, 2017 (Japanese Patent Application No. 2017-109989), the contents of which are incorporated herein by reference.

Features of the embodiment of the power supply circuit breaker device according to the present invention will be briefly summarized below.

[1] A power supply circuit breaker device (1) includes:

a fixed-side connector device (2) provided partway along a power supply circuit (D);

a movable-side connector device (3) that engages with or disengages from the fixed-side connector device (2) to turn ON or OFF the power supply circuit (D); and a rotary connection mechanism (4), configured such that, in engagement or disengagement between the connector devices (2, 3) and the turning ON or OFF of the power supply circuit (D), the movable-side connector device (3) is configured to be linearly movable along an engagement direction (P) of the fixed-side connector device (2) and the movable-side connector device (3), and the movable-side connector device (3) is configured to be rotatably movable in a direction (Q) around a rotation axis parallel to the engagement direction (P).

[2] A power supply circuit breaker device (1) includes:

a fixed-side connector device (2) provided partway along a power supply circuit (D); and a movable-side connector device (3) that engages with or disengages from the fixed-side connector device (2) to turn ON or OFF the power supply circuit (D).

The fixed-side connector device (2) includes: a first terminal (5) having electrical conductivity, which is connected to one side of a divided portion of the power supply circuit (D); a second terminal (6) having electrical conductivity, which is connected to another side of the divided portion of the power supply circuit (D); and an electrically insulating fixed-side connector housing (7), which accommodates the first terminal (5) and the second terminal (6).

The movable-side connector device (3) includes: an electrically insulating movable-side connector housing (26), which is engaged with the fixed-side connector housing (2); and a third terminal (27), which is accommodated in the movable-side connector housing (26) and configured to contact the first terminal (5) and the second terminal (6) to turn ON the power supply circuit (D).

The first terminal (5) and the second terminal (6) include: a first electric contact portion (11) and a second electric contact portion (12), each have a tab-shape protruding along an engagement direction (P) of the fixed-side connector device (2) and the movable-side connector device (3), and are arranged along a direction orthogonal to the engagement direction (P) with a predetermined interval therebetween.

The fixed-side connector housing (7) includes: a fixed-side base portion (17); and a fixed-side cylindrical portion (18), which is formed in a cylindrical shape so as to surround the first electric contact portion (11) and the second electric contact portion (12).

The movable-side connector housing (26) includes: a movable-side base portion (30); and a movable-side cylindrical portion (31), which is formed in a cylindrical shape so as to surround the third terminal (27), and engaged with the fixed-side connector housing (7).

One of the fixed-side cylindrical portion (18) and the movable-side cylindrical portion (31) includes a boss portion (24) which has a protruding shape, while another one of the fixed-side cylindrical portion (18) and the movable-side cylindrical portion (31) includes a slit-shaped or groove-shaped guide portion (33) which is guided by the boss portion (24).

The guide portion (33) includes: a first guide portion (34), which is formed along the engagement direction (P) from an opening edge (41) of the other one; a second guide portion (35), which is continuous with the first guide portion (34) and formed in a direction (Q) around a rotation axis parallel to the engagement direction (P); and a third guide portion (36), which is continuous with the second guide portion (35) and formed on a side away from the opening edge (41) along the engagement direction (P).

[3] The power supply circuit breaker device (1) according to [2] above, in which the fixed-side base portion (17) includes a support portion (22) configured to support an opposite side of each connection surface (15) of the first electric contact portion (11) and the second electric contact portion (12).

[4] The power supply circuit breaker device (1) according to [3] above, in which the power supply circuit breaker device (1) is also provided partway along a signal circuit (S) wired together with the power supply circuit (D).

The fixed-side connector device (2) includes: a fourth terminal (8) having electrical conductivity, which is connected to one side of a divided portion of the signal circuit (S); a fifth terminal (9) having electrical conductivity, which is connected to another side of the divided portion of the signal circuit (S); and an electrically insulating fixed-side signal housing (10), which accommodates the fourth terminal (8) and the fifth terminal (9).

The movable-side connector device (3) includes: an electrically insulating movable-side signal housing (28), which is engaged with the fixed-side signal housing (7); and a sixth terminal (29), which is accommodated in the movable-side signal housing (28) and connected to the fourth terminal (8) and the fifth terminal (9) to perform short-circuiting.

INDUSTRIAL APPLICABILITY

According to the power supply circuit breaker device of the present invention, the operability can be improved when the connector devices are engaged/disengaged and the power supply circuit is turned ON/OFF.

REFERENCE SIGNS LIST

D . . . Power supply circuit, S . . . Signal circuit, 1 . . . Power supply circuit breaker device, 2 . . . Fixed-side connector device, 3 . . . Movable-side connector device, 4 . . . Rotary connection mechanism, 5 . . . First terminal, 6 . . . Second terminal, 7 . . . Fixed-side connector housing, 8 . . . Fourth terminal, 9 . . . Fifth terminal, 10 . . . Fixed-side signal housing, 11 . . . First electric contact portion, 12 . . . Second electric contact portion, 13 . . . First circuit connection portion, 14 . . . Second circuit connection portion, 15 . . . Connection surface, 16 . . . Support surface, 17 . . . Fixed-side base portion, 18 . . . Fixed-side cylindrical portion, 19 . . . Fixing portion, 20 . . . Reinforcing rib, 21 . . . Terminal insertion hole, 22 . . . Supporting portion, 23 . . . Opening edge, 24 . . . Boss portion, 25 . . . Bulging portion, 26 . . . Movable-side connector housing, 27 . . . Third terminal, 28 . . . Movable-side signal housing, 29 . . . Sixth terminal, 30 . . . Movable-side base portion, 31 . . . Movable-side cylindrical portion, 32 . . . Rib, 33 . . . Guide portion, 34 . . . First guide portion, 35 . . . Second guide portion, 36 . . . Third guide portion, 37 . . . Connection surface, 38 . . . Fixed portion, 39 . . . Fixed portion, 40 . . . Male tab, 41 . . . Opening edge, 42 . . . Nut

The invention claimed is:

1. A power supply circuit breaker device, comprising:

a fixed-side connector device provided partway along a power supply circuit; and a movable-side connector device that engages with or disengages from the fixed-side connector device to turn ON or OFF the power supply circuit, wherein the fixed-side connector device includes: a first terminal having electrical conductivity, which is connected to one side of a divided portion of the power supply circuit; a second terminal having electrical conductivity, which is connected to another side of the divided portion of the power supply circuit; and an electrically insulating fixed-side connector housing, which accommodates the first terminal and the second terminal, wherein the movable-side connector device includes: an electrically insulating movable-side connector housing, which is engaged with the fixed-side connector housing; and a third terminal, which is accommodated in the movable-side connector housing and is configured to contact the first terminal and the second terminal to turn ON the power supply circuit, wherein the first terminal and the second terminal include: a first electric contact portion and a second electric contact portion, each have a tab-shape protruding along an engagement direction of the fixed-side connector device and the movable-side connector device, and are arranged along a direction orthogonal to the engagement direction with a predetermined interval therebetween, wherein the fixed-side connector housing includes: a fixed-side base portion; and a fixed-side cylindrical portion, which is formed in a cylindrical shape so as to surround the first electric contact portion and the second electric contact portion, and wherein the movable-side connector housing includes: a movable-side base portion; and a movable-side cylindrical portion, which is formed in a cylindrical shape so as to surround the third terminal and is engaged with the fixed-side connector housing, wherein one of the fixed-side cylindrical portion and the movable-side cylindrical portion includes a boss portion which has a protruding shape, while another one of the fixed-side cylindrical portion and the movable-side cylindrical portion includes a slit-shaped or groove-shaped guide portion which is guided by the boss portion, and wherein the guide portion includes: a first guide portion, which is formed along the engagement direction from an opening edge of the other one; a second guide portion, which is continuous with the first guide portion and formed in a direction around a rotation axis parallel to the engagement direction; and a third guide portion, which is continuous with the second guide portion and formed on a side away from the opening edge along the engagement direction.

2. The power supply circuit breaker device according to claim 1, wherein the fixed-side base portion includes a support portion configured to support an opposite side of each connection surface of the first electric contact portion and the second electric contact portion.

3. The power supply circuit breaker device according to claim 2, wherein the power supply circuit breaker device is also provided partway along a signal circuit wired together with the power supply circuit, wherein the fixed-side connector device includes: a fourth terminal having electrical conductivity, which is connected to one side of a divided portion of the signal circuit; a fifth terminal having electrical conductivity, which is connected to another side of the divided portion of the signal circuit; and an electrically insulating fixed-side signal housing, which accommodates the fourth terminal and the fifth terminal, and wherein the movable-side connector device includes: an electrically insulating movable-side signal housing, which is engaged with the fixed-side signal housing; and a sixth terminal, which is accommodated in the movable-side signal housing and is connected to the fourth terminal and the fifth terminal to perform short-circuiting.

* * * * *